United States Patent [19]

Barth

[11] 4,221,151

[45] Sep. 9, 1980

[54] STRINGED MUSICAL INSTRUMENT

[76] Inventor: Thomas G. Barth, P.O. Box 136, Main St., Port Murray, N.J. 07865

[21] Appl. No.: 61,364

[22] Filed: Jul. 27, 1979

[51] Int. Cl.[3] ..... G10D 3/06

[52] U.S. Cl. ..... 84/314 R; 84/293; 84/314 N

[58] Field of Search ..... 84/293, 314 R, 314 N

[56] References Cited

U.S. PATENT DOCUMENTS

| | | | |
|---|---|---|---|
| 1,596,763 | 8/1926 | Place | 84/293 |
| 2,458,263 | 1/1949 | Harlin | 84/314 N |
| 3,174,380 | 3/1965 | Cookerly et al. | 84/314 N |
| 3,273,439 | 9/1966 | Keefe et al. | 84/314 R |
| 3,538,807 | 11/1970 | Francis | 84/293 |
| 3,712,952 | 1/1973 | Terlinde | 84/314 R |

FOREIGN PATENT DOCUMENTS

| | | | |
|---|---|---|---|
| 2553563 | 6/1977 | Fed. Rep. of Germany | 84/314 R |

*Primary Examiner*—Lawrence R. Franklin

*Attorney, Agent, or Firm*—Mel K. Silverman; Mahendra A. Gandhi

[57] ABSTRACT

The present invention discloses a stringed musical instrument. The stringed musical instrument comprises a body having a string-slider nut assembly; a neck having a rectangular slot; a T-bar assembly having a plurality of holes fastened securely in the rectangular slot of the neck of the instrument; a finger board consisting of a plurality of rectangular pieces forming a plurality of lengthwise spaced recesses when the rectangular pieces are placed adjacent to each other, wherein the fingerboard is placed upon the T-bar assembly, and tubular barrel frets are secured firmly in the lengthwise space recesses formed in the fingerboard with barrel fret screws. The string-slider nut assembly includes a number of pulleys, through which a given string passes so that the string can be stretched to produce a high pitch and a "sliding" musical tone, as may be desired.

4 Claims, 5 Drawing Figures

STRINGED MUSICAL INSTRUMENT

BACKGROUND OF THE INVENTION

The present invention relates to a stringed musical instrument such as a guitar. More particularly, the present invention relates to an instrument which accommodates removable frets, a T-bar assembly and an improved string-slider nut assembly.

The fingerboard is that part of a fretted-stringed instrument on which the frets are secured. Frets are installed on the fingerboard, perpendicular to the major axis of the fingerboard, with a proper spacing. The frets are usually made of metal and are inserted into slots cut into the wooden fingerboard and held there by friction. When the frets become worn, damaged or otherwise in need of replacement, they must be pried out of the wooden fingerboard and a new fret inserted into the slot which previously held the fret being replaced. This task requires much time by a person skilled in such type of work. Also, with each replacement of a fret in the same slot, the slot becomes less able to hold the new fret with proper friction; this is due to the resulting enlargement of the slot. Also, the wood may warp and cause the fret to move, which is highly undesirable in musical instruments.

The prior art is represented by such patents as:

U.S. Pat. No. 973,719 (1910) to Consoli;
U.S. Pat. No. 1,692,207 (1928) to Hall;
U.S. Pat. No. 1,707,192 (1929) to Overton;
U.S. Pat. No. 1,727,620 (1929) to Smith;
U.S. Pat. No. 3,103,846 (1963) to Webster; and
U.S. Pat. No. 3,273,439 (1966) to Keefe.

The above patents disclose the existence of fingerboard and frets; however, in each case, the structural stability and removability of such prior art frets have not been fully adequate to meet the needs of easy repair and an improved stringed musical instrument. More particularly, Keefe discloses removable frets on any fretted stringed instrument; however, the structural stability of the frets is inadequate.

Also, the prior art does not disclose a novel string-slider nut assembly on any stringed instrument.

Accordingly, it may be appreciated that a need for such an instrument has long existed in the prior art.

SUMMARY OF THE INVENTION

The present invention discloses a stringed musical instrument. The stringed musical instrument comprises a head having a string-slider nut assembly; a neck having a rectangular slot; a T-bar assembly having a plurality of holes fastened securely in the rectangular slots of the neck of the instrument; a finger-board consisting of a plurality of rectangular pieces, forming a plurality of lengthwise spaced recesses when the rectangular pieces are placed adjacent to each other, wherein the fingerboard is placed upon the T-bar assembly, and a tubular barrel frets are secured firmly in the lengthwise space recesses formed in the fingerboard with a barrel fret screws. The string slider nut assembly includes a number of pulleys, through which a given string passes so that the string can be stretched to produce a high pitch and a "sliding" tone, as may be desired.

It is an object of the present invention to provide a nominal cost, maintenance free, and a durable stringed musical instrument.

It is another object to provide a removable fret and a T-bar assembly to secure the frets in their respective positions.

It is a yet further object to provide a string-slider nut assembly in a musical instrument, so that a particularly high pitch and a "sliding" tone music, e.g., Hawaiian-style music, can be developed.

Other objects and advantages of the present invention will become apparent from the hereinafter set forth Detailed Description of the Invention.

DETAILED DESCRIPTION OF THE INVENTION

Figure 1:
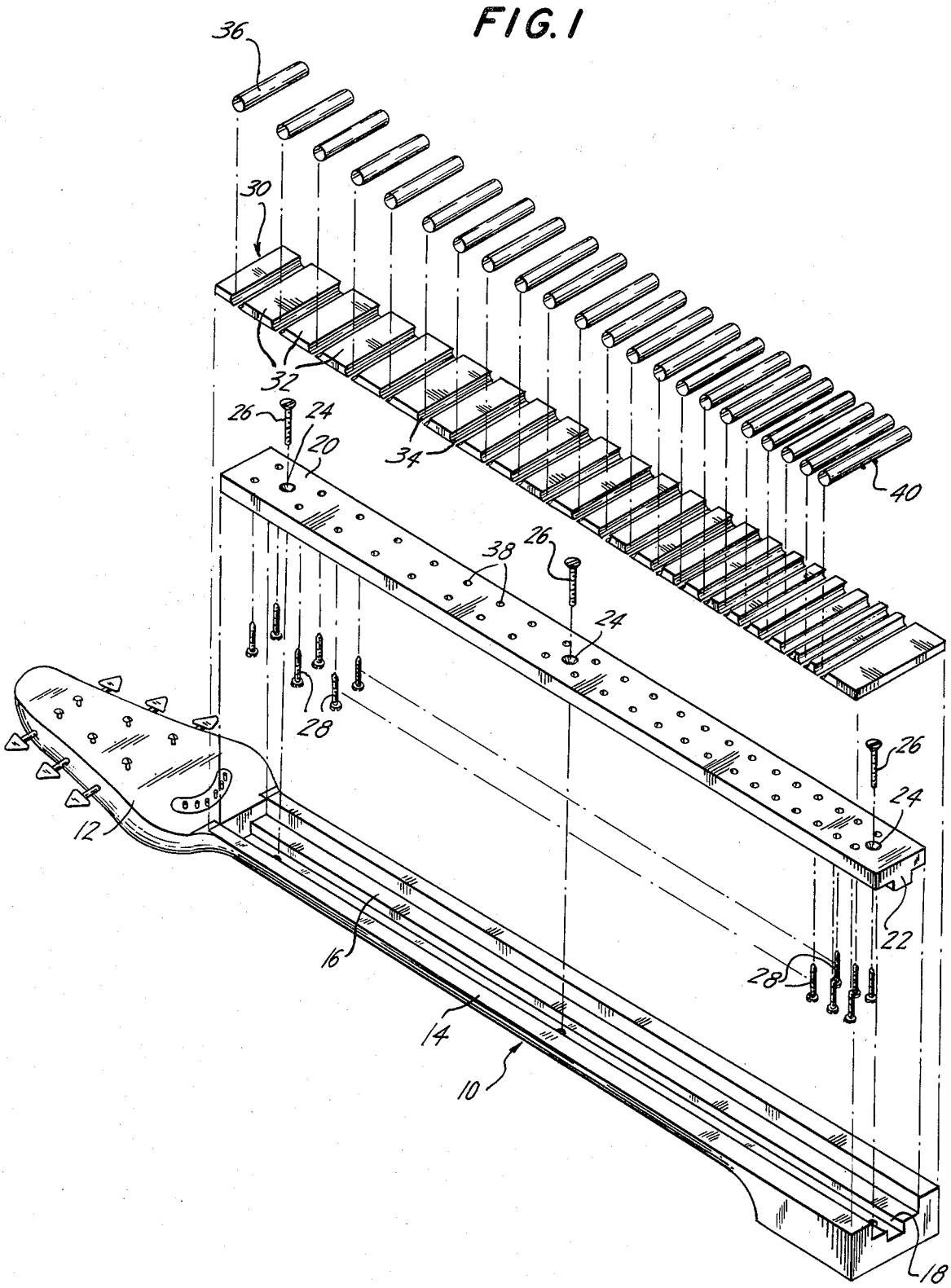
FIG. 1 is an isometric view, exploded to illustrate the frets and T-bar assembly provided on the fingerboard of a stringed musical instrument, for holding the frets in their respective positions.

With reference to FIG. 1, element 10 denotes a stringed musical instrument, generally a guitar, having a head portion 12 and a lower portion, usually called a neck 14 with a rectangular slot 16, and a groove 18 at the end thereof. A T-bar assembly 20, made of a suitable material such as forged aluminum, having an end shape 22 complemental to the groove 18 in the neck 14, is placed in the rectangular slot 16. The T-bar assembly 20 is provided with at least two fastener assemblies including holes 24 to receive T-bar fastener screws, or female threaded inserts 26, so that the T-bar assembly can be held in its place. In order to provide more holding capacity, the fastener assembly can be provided at more than two locations, for example, a first assembly at one end; second assembly in the center; and a third at the other end of the T-bar assembly. The T-bar assembly is also provided with two rows of holes lengthwise or a plurality of holes 38 spaced lengthwise to receive the barrel fret screws 28. The T-bar assembly keeps the neck in its place, providing required structural stability; and more particularly, preventing the wood material of the neck from bending, shrinking or warping as the case may be.

A fingerboard 30 is made of a suitable material such as wood or plastic, and it is constructed of a plurality of rectangular pieces 32, unlike a standard fingerboard which is one piece. A groove or a lengthwise spaced recess 34 is formed in the placement of two rectangular pieces into the fingerboard.

A barrel fret 36, usually tubular in shape, and circular in cross section; accommodates a groove 34, so that it can slide out between the fingerboard and the T-bar assembly. Each barrel fret is typically provided with two holes 40 which receive the barrel fret screws 28. The barrel fret screws secure the frets 36 firmly through the holes 38 in the T-bar assembly 20.

The advantage of easy maintenance and repair is evident in case of a replacement of a damaged fret or a fingerboard. All of the frets can be replaced very easily by a person of limited mechanical skill, and a skilled craftsman will not be required to do the same. Further, the advantage of accurate tuning and prevention of a warping of a neck of the instrument is evident.

Figure 2:
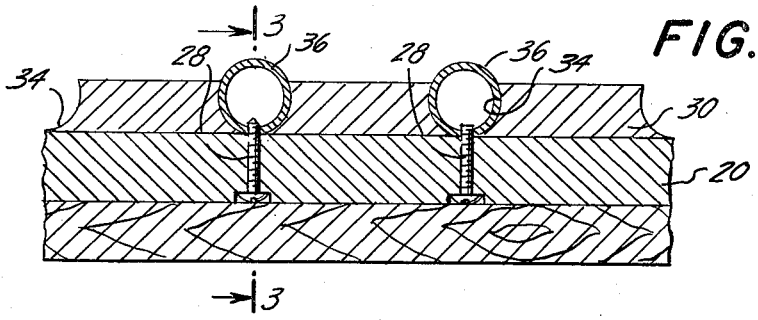
FIG. 2 is an elevation of a fragmented portion of the fret assembly illustrating a fret in position which is attuned in accordance with this invention.
Figure 3:
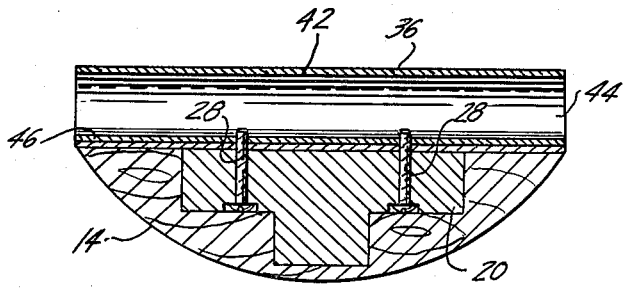
FIG. 3 is a cross section of the fret assembly.

In FIGS. 2 and 3 the fret, as above referred to, is secured firmly in relation to the neck portion 14 of the stringed musical instrument, usually a guitar. The barrel fret screws 28, usually sheet metal screws, will pass through the T-bar assembly to engage the holes provided in the frets. The fret 36, as illustrated, is hollow or tubular and comprises an outside wall 42 and an inside wall 44. The barrel fret screws 28 passes through lower outside wall 46 of the fret but not to the outside wall 42 of the fret. The spacing between the barrel frets remains constant and, therefore, an accurate tuning can be accomplished.

In case of a warping or a shrinking of a rectangular slot 32 of a fingerboard 30; or of a neck 14, the tuning is unaffected because of the metallic T-bar assembly and the fret assembly as described hereinbefore.

Figure 4:
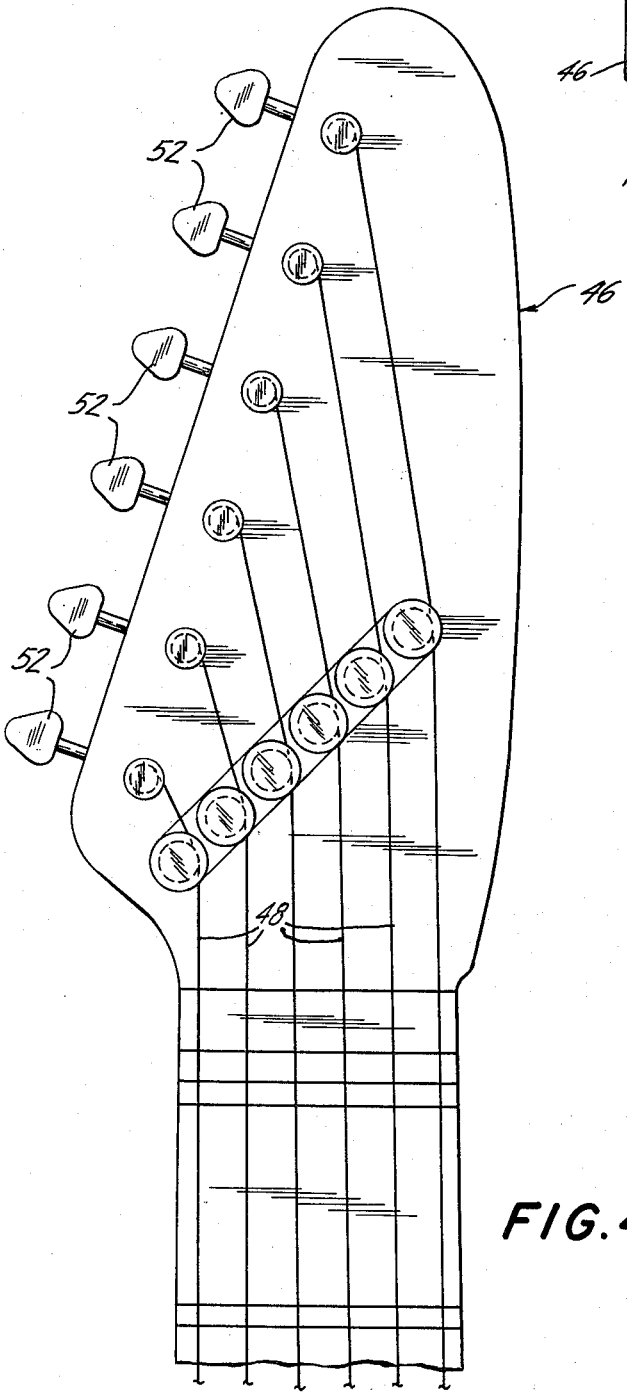
FIG. 4 is a top plan view of a head of the instrument illustrating a string-slider nut assembly.
Figure 5:
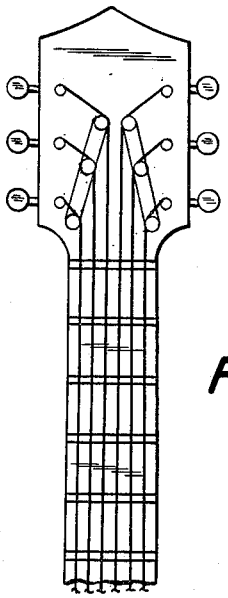
FIG. 5 is a top plan view of a head of the instrument illustrating an alternate arrangement of the string-slider nut assembly.

With reference to FIG. 4, an enlarged view of a string-slider nut assembly 46 over the body portion 12 of the guitar 10 is illustrated. The assembly 46 essentially consists of: a plurality of assemblies 50 having a curved radial surface, like a pulley, along which a plurality of strings 48 pass. Each are suitably adjusted by posts 50 and turning handles 52. This is called a six in-line type head assembly. An alternate arrangement of the string slider nut assembly, called a three-and-three type head assembly, in which three posts are arranged on one side, and the other three posts are arranged on an opposite side is illustrated in FIG. 5. The main advantage of the assembly, as illustrated above, is a "string bending", which in turn, raises the pitch thereof, and allows a sliding note, wherein a brilliant music, such as Hawaiian music, or a country-western type of music is effectively accomplished. In such assembly, it will allow the strings to travel across the beginning of the fret scale that normally would be notched in a standard guitar.

While there have been herein shown and described the preferred embodiments of the present invention, it will be understood that the invention may be embodied otherwise than as herein specifically illustrated or described and that within said embodiments certain changes in the detail and construction, and the form of arrangement of the parts may be made without departing from the underlying idea or principles of this invention within the scope of the appended claims.

What is claimed is:

1. A stringed musical instrument comprising:

(a) a head having a string slider nut assembly;

(b) a neck having a rectangular slot;

(c) a T-bar assembly having a plurality of holes fastened securely in the rectangular slot of said neck of the instrument;

(d) a fingerboard comprising a plurality of rectangular pieces, forming a plurality of lengthwise-spaced recesses in which said rectangular pieces are placed adjacent to each other and are placed upon said T-bar assembly;

(e) tubular barrel frets, each of said frets having at least two holes, said frets secured firmly in said lengthwise spaced recesses formed in said fingerboard.

2. The instrument as recited in claim 1 in which the T-bar assembly further comprises: at least two fastener assemblies including holes and screws to secure said T-bar assembly firmly with said neck of the instrument.

3. The instrument as recited in claim 1 further comprising barrel fret screws passing through the plurality of holes in said T-bar assembly and firmly engaging said tubular barrel frets.

4. The instrument as recited in claim 1 in which the slider nut assembly further comprises:

(a) a plurality of assemblies arranged on the body of the instrument; and (b) strings which are suitably adjusted by posts and turning handles secured on the body portion of the instrument, each of said assemblies having a curved radial surface through which said strings pass, so that a given string can be stretched to produce a high pitch and a sliding musical tone, as may be desired.

* * * * *